US005114319A

United States Patent [19]

Faber

[11] Patent Number: 5,114,319

[45] Date of Patent: May 19, 1992

[54] CONCRETE-PUMPING DEVICE

[76] Inventor: Pieter Faber, No. 19; Des Meute NL-8213 BH, Creil, Netherlands

[21] Appl. No.: 595,242

[22] Filed: Oct. 10, 1990

[30] Foreign Application Priority Data

Oct. 13, 1989 [NL] Netherlands ..... 8902546

[51] Int. Cl.[5] ..... F04B 17/00

[52] U.S. Cl. ..... 417/342; 417/900; 417/344

[58] Field of Search ..... 417/269, 271, 342, 344, 417/347, 346, 345, 900

[56] References Cited

U.S. PATENT DOCUMENTS

| | | | |
|---|---|---|---|
| 3,262,395 | 7/1966 | Morando | 417/271 |
| 3,279,383 | 10/1966 | Smith | 417/900 |
| 3,295,451 | 1/1967 | Smith . | |
| 3,367,272 | 2/1968 | Smith | 417/271 |
| 3,588,294 | 6/1971 | Schlecht | 417/900 |
| 3,650,638 | 3/1972 | Cole | 417/900 |
| 3,663,129 | 5/1972 | Antosh | 417/516 |
| 3,981,622 | 9/1976 | Hall et al. | 417/346 |
| 4,105,373 | 8/1978 | Calzolari | 417/900 |
| 4,470,771 | 9/1984 | Hall et al. | 417/346 |
| 4,490,096 | 12/1984 | Box | 417/346 |
| 4,714,411 | 12/1987 | Searle | 417/347 |

FOREIGN PATENT DOCUMENTS

| | | |
|---|---|---|
| 0249175 | 12/1987 | European Pat. Off. . |
| 3219982 | 12/1983 | Fed. Rep. of Germany . |
| 2163145 | 7/1973 | France . |

*Primary Examiner*—Richard A. Bertsch
*Assistant Examiner*—Michael I. Kocharov
*Attorney, Agent, or Firm*—Mark Zovka

[57] ABSTRACT

Concrete-pumping device comprising a frame, a number of pump cylinders mounted on the frame which comprise a pump opening close to one end, sealed pump pistons which are guided slidably in the pump cylinders toward and away from the pumping device and which are each coupled to reciprocal driving to the plunger of a coaxially arranged hydraulic jack, hydraulic switching means for cyclically feeding to and discharging from the jack hydraulic oil under pressure such that the plunger causes the reciprocating movement of the pump piston and concrete switching means for alternately placing the pump opening in communication with a feed funnel and a pressure conduit for concrete synchronously with the movement of the pump piston in order to pump concrete out of the feed funnel into the pressure conduit. This comprises at least three pump cylinders with associated hydraulic jacks and the hydraulic and concrete switching means are embodied such that each time before a pump cylinder has completed a pressure stroke another pump cylinder has already completed the suction stroke and the pump opening of this other pump cylinder is connected to the discharge line, and that the pressure stroke of this other pump cylinder immediately begins at the moment the pressure stroke of the one pump cylinder has been completed.

19 Claims, 5 Drawing Sheets

FIG.3
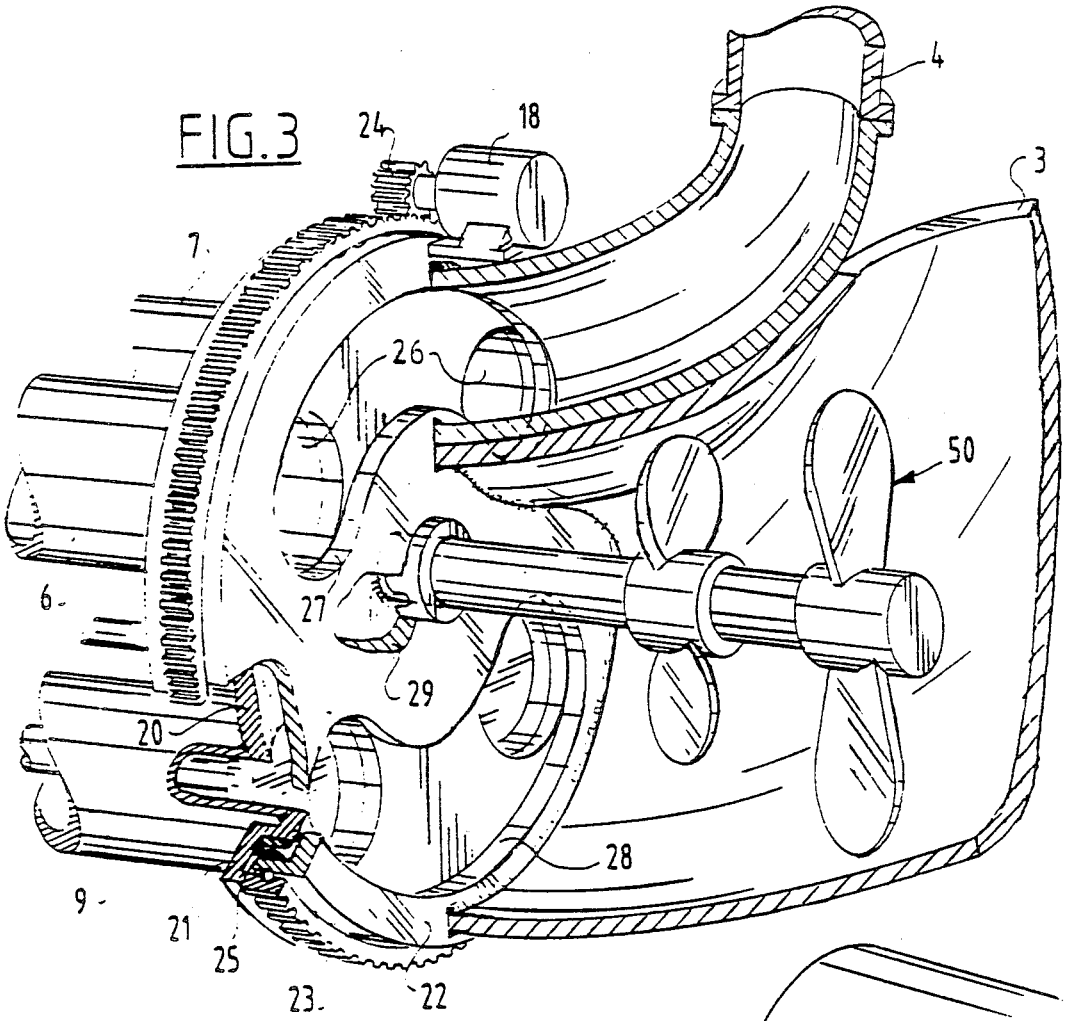
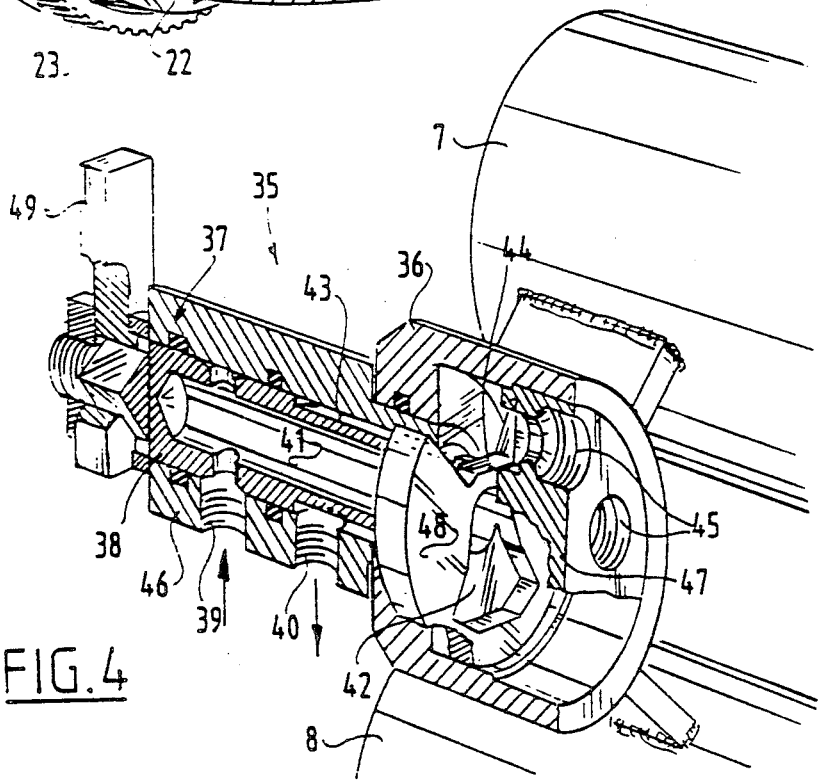
FIG.4

CONCRETE-PUMPING DEVICE

The invention relates to a concrete-pumping device comprising a frame, a number of pump cylinders mounted on the frame which comprise a pump opening close to one end, sealed pump pistons which are guided slidably in the pump cylinders toward and away from the pumping device and which are each coupled for reciprocal driving to the plunger of a coaxially arranged hydraulic jack, hydraulic switching means for cyclically feeding to and discharging from the jack hydraulic oil under pressure such that the plunger causes the reciprocating movement of the pump piston and concrete switching means for alternately placing the pump opening in communication with a feed funnel and a pressure conduit for concrete synchronously with the movement of the pump piston in order to pump concrete from the feed funnel into the pressure conduit.

With known concrete-pumping devices two pump cylinders operate alternately. The hydraulic switching means and the concrete switching means are reversed at the end of each stroke. During this reversing no concrete is pressed under pressure into the pressure conduit so that the pumping device operates pulsatingly. This pulsating operation is inconvenient particularly when the pressure conduit is arranged along a jib in order to be able to pour the concrete at a distance from the pumping device. Forces occurring due to the pulsatory action cause the jib to move up and down whereby the handling thereof is made difficult.

The invention therefore has for its object to provide a pumping device wherein this drawback does not occur.

With a concrete-pumping device according to the invention this is achieved in that this comprises at least three pump cylinders with associated hydraulic jacks and the hydraulic and concrete switching means are embodied such that in each case before a pump cylinder has completed a pressure stroke another pump cylinder has already completed the suction stroke and the pump opening of this other pump cylinder is connected to the discharge line and that the pressure stroke of this other pump cylinder immediately begins at the moment the pressure stroke of the one pump cylinder has been completed. The pressure strokes of the pump cylinders hereby follow one another without interruption, whereby a continuous, pulse-free flow occurs in the pressure conduit.

A particularly favourable embodiment of the device according to the invention is one wherein the switching means are embodied reliably and operationally reliably despite the extra pump cylinder or cylinders.

The switching position of the hydraulic switching means and the concrete switching means is preferably determined by the rotation position of the rotatable unit so that synchronizing of these switching means is assured in a simple manner.

According to a further favourable development wherein the rotation drive means are arranged such that when a quantity of oil has passed through its motor corresponding with a complete reciprocating stroke of all jacks, the unit has rotated one revolution. Thus ensured is that the pump cylinders perform a complete pumping stroke each time irrespective of the operational conditions such as the composition of the concrete and the counter pressure experienced partly as a result thereof.

Preferably the action of the pump cylinders can be reversed by rotating the valve part of the hydraulic switching means connected to the frame, that is, instead of pumping concrete out of the feed funnel to the pressure conduit, pumping it out of the pressure conduit back to the feed funnel. When a blockage occurs in the pressure conduit, something which can occur in practice, this blockage can practically always be cleared by switching the pumping device reciprocally. This can take place with the device according to this preferred embodiment in a simple manner by reciprocally rotating the rotatable slide valve part.

In many circumstances the hydraulic jack of the pump cylinder, which is already placed in communication with the pressure conduit while another pump cylinder is still occupied with the pressure stroke, can already be placed under hydraulic pressure. The pressure stroke will only begin when the pump cylinder already pressing has arrived at the end of its stroke because in order to set in motion the column of concrete received in the pump cylinder a greater force is needed than to maintain the movement of a concrete mass which is already in motion. Hereby automatically achieved is that the pressure stroke of the following pump cylinder in the cycle immediately begins at the moment the pressure stroke of the preceding pump cylinder in the cycle has been completed.

To be able also to effect this operation with certainty under difficult operational conditions, the step of claim 6 can be applied. The angle through which the valve part connected to the frame is rotated reciprocally each time can be adjusted such that the moment of switching on of the pressure of the pressure stroke of the following pump cylinder is delayed until the moment that the pressure stroke of the preceding pump cylinder is practically wholly completed. Resulting from the accelerated setting into operation as a consequence of the reverse rotation of the slide valve part is a close succession of pressure strokes and therefore pulse-free transportation of concrete in the pressure conduit.

A preferred embodiment which is distinguished by a simple and therefore operationally reliable construction can be shown. The two hydraulic jacks of a pair can be controlled as a single hydraulic jack so that the hydraulic switching means can be considerably simplified.

A further advantage of the present invention concerns the feed funnel. The outflow of the feed funnel can hereby be situated at a low level so that the feed funnel can be easily filled from a concrete mixing vehicle.

When a stirring member fixedly connected to the rotatable unit protrudes into the feed funnel it is achieved in a simple manner that the concrete in the feed funnel remains in a properly mixed state.

With known concrete-pumping devices the lower part of the pump cylinders is considerably more subject to wear than the remaining part. The device according to the invention wherein the pump cylinders are combined into a rotating unit has the additional advantage that due to the rotation wear is distributed over the entire periphery of the cylinders so that the useful life of the pump cylinders is considerably increased.

The invention will be further elucidated in the following description of an embodiment.

FIG. 3 shows a partly broken away perspective view along arrow III in FIG. 2;

FIG. 4 shows a partly broken away perspective view along arrow IV in FIG. 2;

Figure 1:
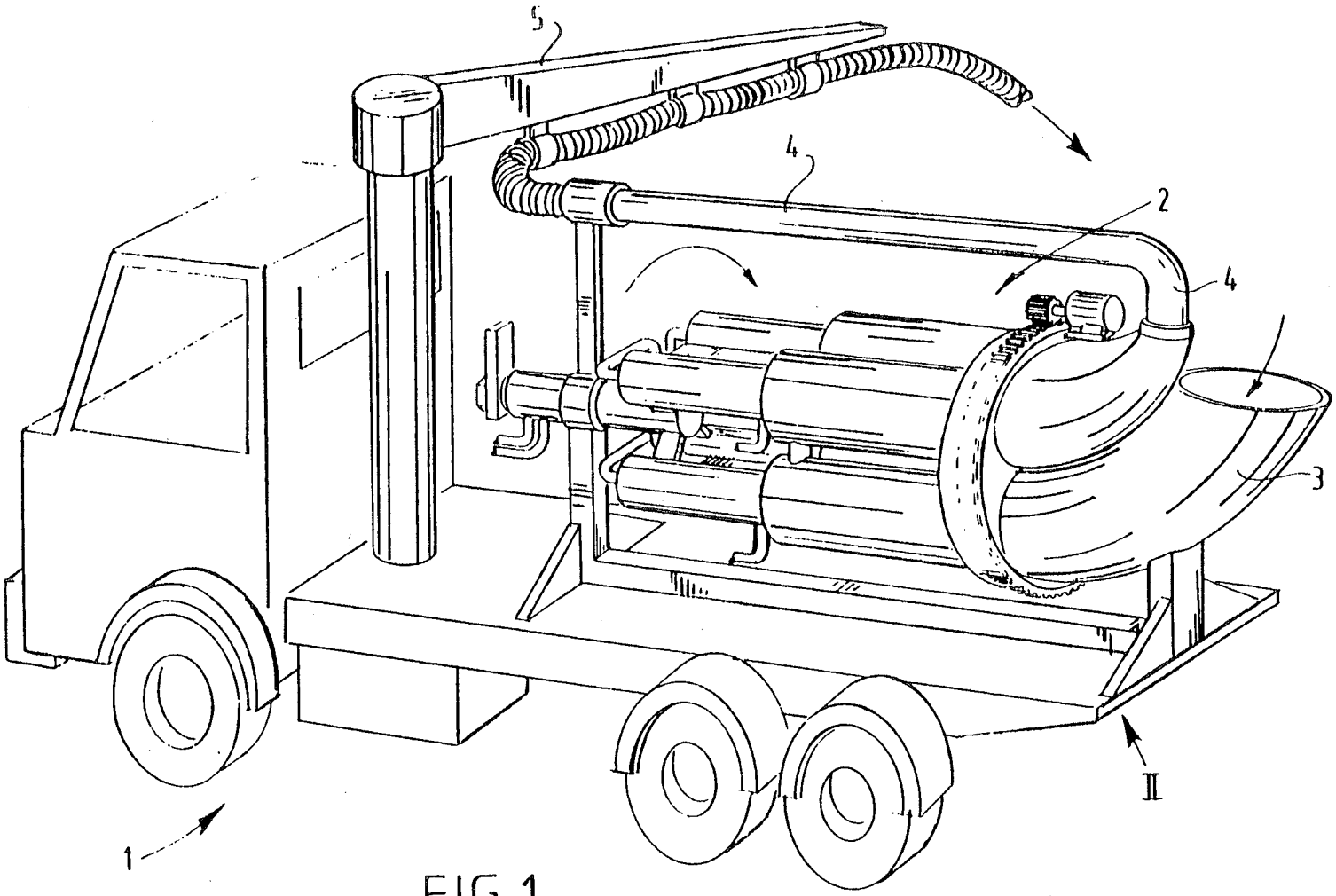
FIG. 1 shows in perspective view a concrete-pumping device according to a preferred embodiment of the invention, constructed as a vehicle.

The concrete-pumping device according to the invention shown in FIG. 1 is embodied as a concrete-pumping truck. The actual concrete pump 2 is mounted between the chassis beams of the truck. The pump is provided with a feed funnel 3 into which concrete can be poured from a concrete mixer. The concrete is pressed by the concrete pump 2 out of the feed funnel 3 into a pressure conduit 4. This pressure conduit 4 extends along a jib 5 so that concrete can be poured at distance and at height using a concrete-pumping vehicle 1.

Figure 2:
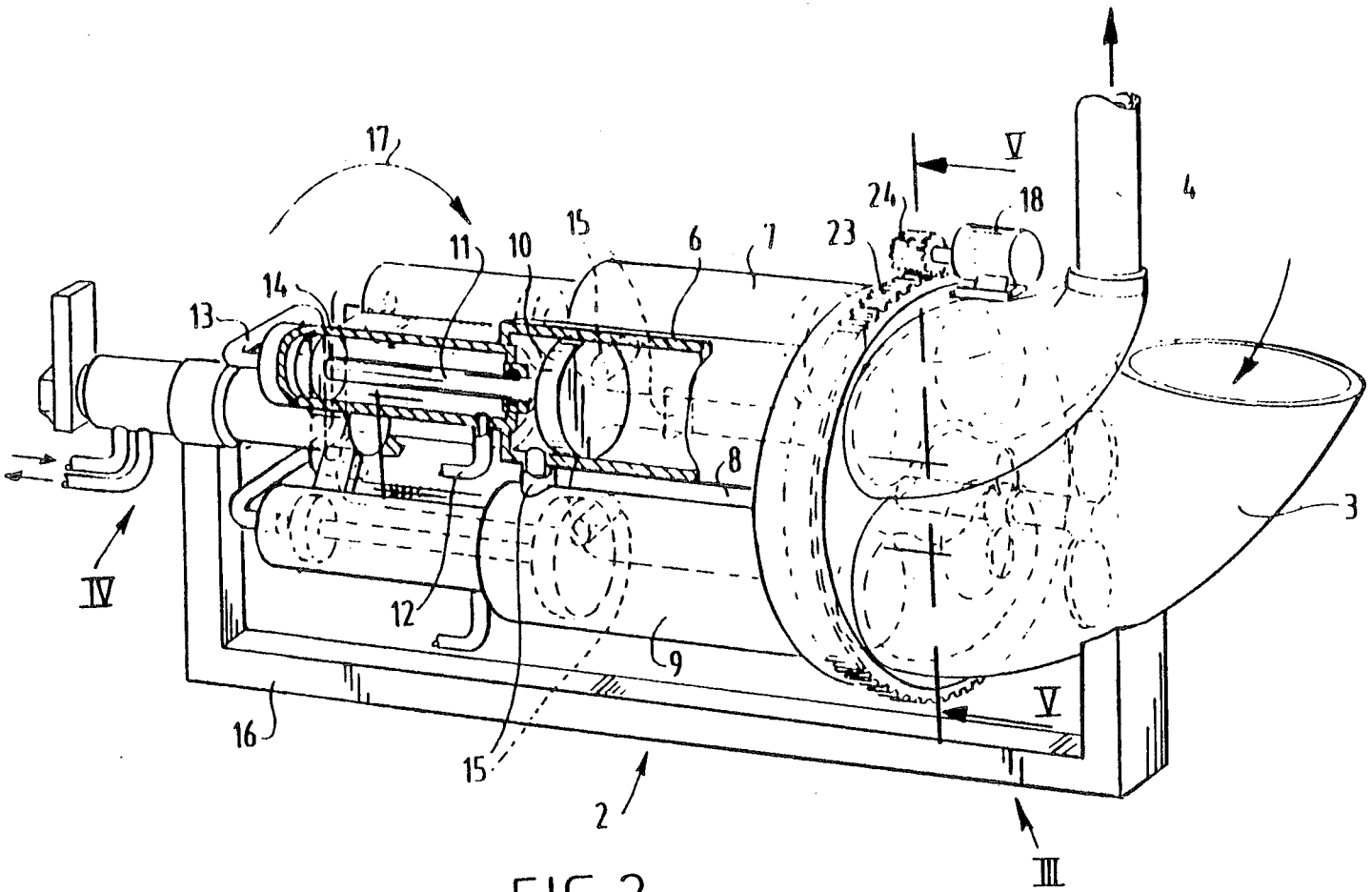
FIG. 2 shows a partly broken away perspective view of the actual concrete pump along the arrow II in FIG. 1.

The actual concrete pump 2 is shown in more detail in FIG. 2. According to the invention the concrete pump 2 comprises four pump cylinders 6, 7, 8, and 9. As can be seen in the case of the pump cylinder 6, each pump cylinder comprises a pump piston 10 which is connected to the plunger 11 of a hydraulic jack 14. Through suitable feed and discharge of hydraulic oil, as will be further described, the pump piston 10 can be moved reciprocally in the pump cylinder 6.

The four pump cylinders 6–9 are assembled together with their associated hydraulic jacks into a unit mounted rotatably round a lengthwise shaft. This unit is rotatably mounted relative to the schematically indicated frame 16.

As shown in FIG. 3, the front ends of the pump cylinders 6–9 are fixedly welded for this purpose to a disc 20 such that the open ends of the pump cylinders 6–9 functioning as pump openings connect onto openings 26 in this disc 20. Along the edge of the disc 20 is arranged a rotary crown part 21. This rotary crown part 21 co-acts with a rotary crown part 22 arranged on a disc 29 fixedly connected to the frame. The disc 29 lies sealingly against the disc 20. In the disc 29 are arranged kidney-shaped openings, respectively a suction opening 28 on the underside and a pressure opening 27 on the upper part. Arranged in the rotary crown part 21, 22 is a sealing 25 which prevents liquid leaking to the outside between the two discs 20, 29.

Around the rotary crown part 21, 22 is mounted a gear ring 23. This gear ring 23 is in engagement with a pinion 24 which is driven by a hydrostatic motor 18 in a manner to be described later with reference to FIG. 7.

Figure 7:
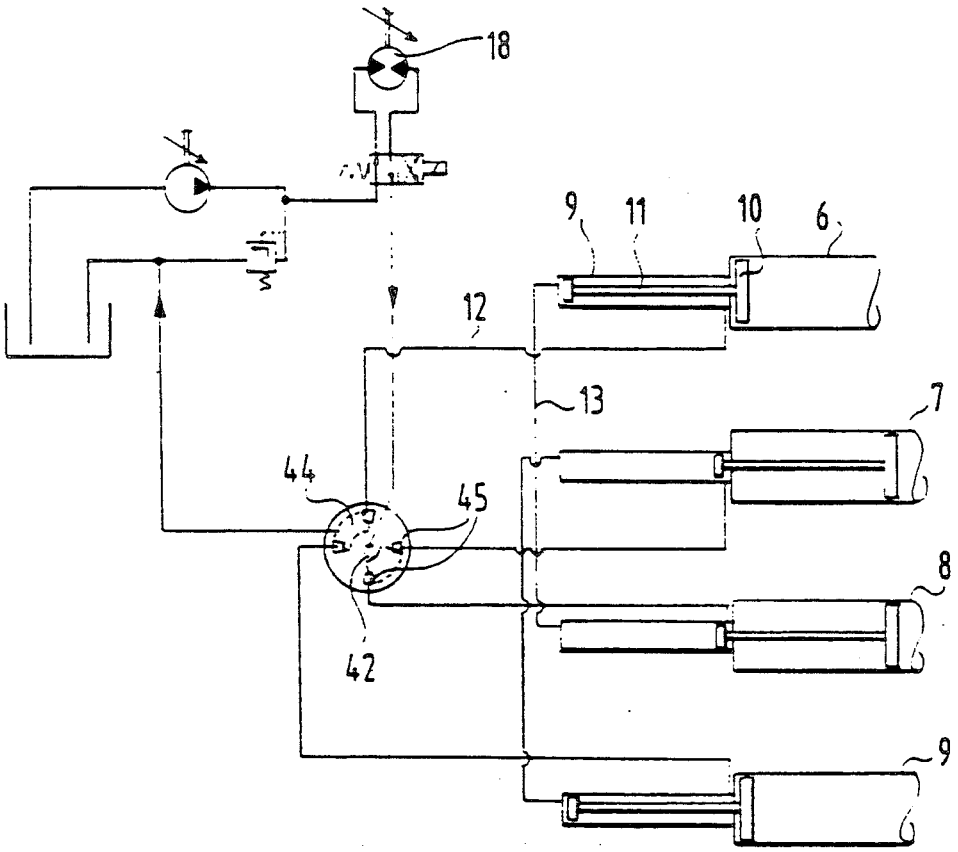
FIG. 7 shows the hydraulic principle diagram of the driving of the concrete pump according to FIG. 2.

Hydraulic switching means 35 which bring about the reciprocating stroke of the hydraulic jacks are arranged at the opposite end of the rotatable unit and are shown in more detail in FIG. 7. The hydraulic switching means 35 comprise a valve part 36 which is fixedly connected to the rotating unit and therefore co-rotates therewith. A second valve part 37 is connected to the frame and comprises a non-rotatable housing 46 and an positioning slide 38 mounted rotatably therein. Arranged in the housing 46 are a feed port 39 for hydraulic oil under pressure and a discharge port 40 for hydraulic oil. The feed port 39 communicates with a core channel 41 of the positioning slide 38. The core channel debouches into a pressure recess 42 in a disc-like head 48 of the positioning slide 38. The discharge port 40 communicates with a casing channel 43 formed between the housing 46 and the slide 38 itself. This casing channel 43 communicates in turn with a suction recess 44 of the head disc. The rotating part 36 of the hydraulic switching means 35 comprises a disc 47 which lies against the head disc 48 and wherein are formed four connecting ports 45 which are connected by suitable lines to the hydraulic jacks in the manner made clear in FIG. 7. When the rotatable unit is rotated the respective connecting ports 45 come to lie alternatingly in front of the pressure recess 42 and the suction recess 44. As FIG. 7 shows, two pump cylinders with hydraulic jacks lying diametrically opposite one another are connected in each case to form oppositely moving pairs 6, 8 and 7, 9. The spaces behind the plungers are mutually connected as by a line 13 while the spaces in front of the plungers are connected by suitable lines, such as line 12, to connecting ports 45 situated diametrically opposite each other. When one connecting port 45 is situated in front of the pressure recess 42 the connecting port 45 lying diametrically opposite is situated in front of the suction recess 44 so that hydraulic oil under pressure can flow via the feed port 39, the core channel 41 and the pressure recess 42 to one of the hydraulic jacks of the relevant pair on the front side of the plunger thereof. Through the pressure exerted on the plunger this is constrained rearward wherein hydraulic oil is displaced from the space behind the plunger via the connecting line to the space behind the other plunger of the pair. This is hereby forced forward wherein the hydraulic oil flows out of the space in front of the plunger via the line to the relevant port 45 and there flows back via the suction connection, the casing channel 43 and the discharge port 40. When the rotating unit is turned through 90 degrees the two other pump cylinder-jack units will be driven in the manner described and at a following rotation through 90 degrees the pump cylinder-jack units of the first pair will again be driven in the opposing direction.

Figure 5:
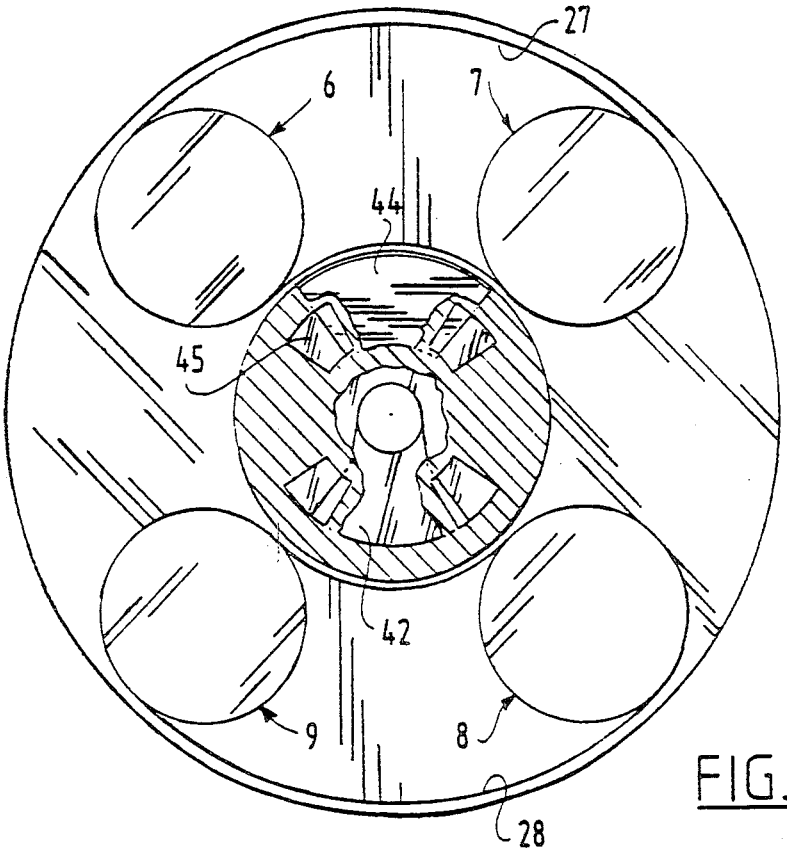
FIG. 5 shows a partial section along line IV—IV in FIG. 2.
Figure 6:
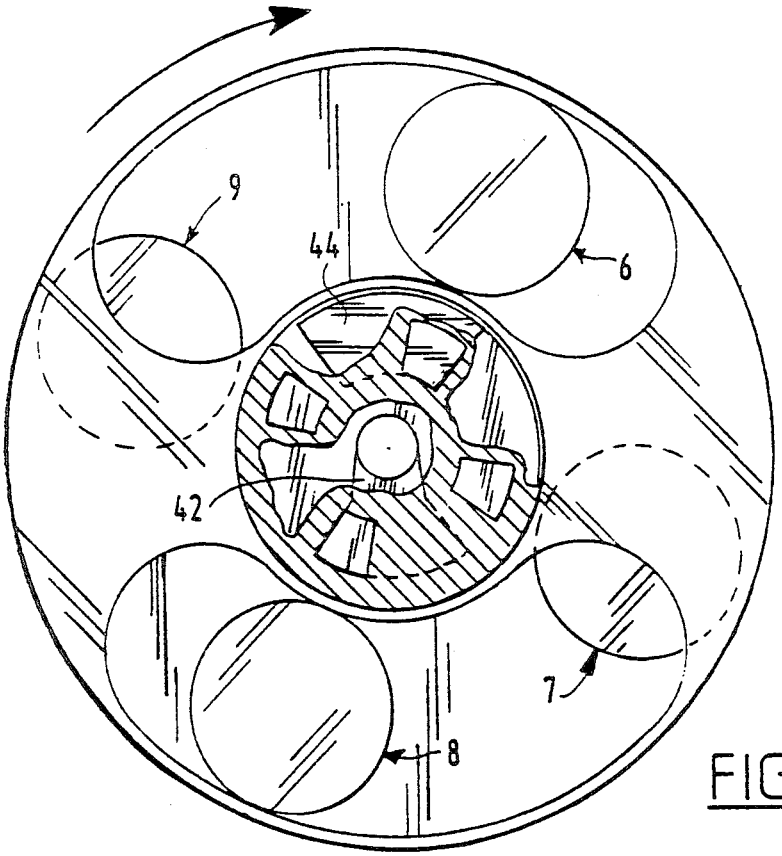
FIG. 6 shows a section corresponding with FIG. 5 in a somewhat rotated position of the device relative thereto.

FIG. 5 and 6 show schematically the co-action of the concrete switching means described with reference to FIG. 3 and the hydraulic switching means described with reference to FIG. 4 and 7. FIG. 5 shows the position of the rotatable unit as shown in FIG. 2. The pump cylinder 6 is rotated therein in the disc 29 just before the beginning of the kidney-shaped pressure opening 27 while the pump cylinder 7 is still situated just at the end of this pressure opening 27. Shown in FIG. 5 and 6, in each case in the middle, is the associated position of the hydraulic switching means 35 wherein the openings 45 in each case correspond with the pump cylinder standing in the same angular position. That is, the opening 45 standing in the same angular position as a particular pump cylinder is joined to the space in front of the plunger of the hydraulic jack associated with the relevant pump cylinder. FIG. 5 shows that the opening 45 associated with the pump cylinder 7 is still just in communication with the suction recess 44 while the opening 45 associated with the pump cylinder 9 is still just in communication with the pressure recess 42 of the hydraulic switching means 35. The pump cylinder 7 therefore carries out a pressure stroke while the pump cylinder 9 performs a suction stroke. As FIG. 7 shows, all the hydraulic oil under pressure flows to the hydraulic jacks via the hydrostatic motor 18 which rotates the turning unit. This hydrostatic motor 18 is adjusted such that in the case of a complete revolution of the rotatable unit so much hydraulic oil has passed through the motor 18 that all the hydraulic jacks and therefore the pump cylinders have performed a complete reciprocating stroke and have thus returned to the starting position. In the situation shown, each pump cylinder thus performs a pressure stroke as it passes along the pressure opening 27 and a suction stroke as it passes along the suction opening 28. In FIG. 5 the pump cylinder 7 is thus practically at the end of the pressure stroke while the pump cylinder 6 is located at the start of the pressure stroke. The pump cylinder 8 is likewise at the start of the suction stroke and the pump cylinder 9 at the end thereof. During the movement between the suction opening and the pressure opening and vice versa, such as for the pump cylinders 9 and 7 during the displacement between the position just past that of FIG. 5 and that of FIG. 6, the relevant pump cylinders stand still because the corresponding openings 45 are not in communication with either the suction recess or the pressure recess of the hydraulic switching means 35. In the position in FIG. 5 the hydraulic jack of the pump cylinder 6 already comes under pressure before the pressure stroke of the cylinder 7 is wholly completed. The pressure is the same and dependent on the resistance in the pressure conduit 4. Since a greater pressure is necessary to set in motion the quantity of concrete present in the cylinder 6 than to maintain the movement of the quantity of concrete still remaining in the cylinder 7, the pump piston of the cylinder 6 remains stationary until the pump piston of the cylinder 7 has reached the end position. At that moment the pressure stroke of the cylinder immediately begins. No pulse hereby occurs during the transition and the concrete continues to flow pulse-free through the pressure conduit 4.

In very particular circumstances, for example in the case of inconsistent composition of the concrete for pumping, it is possible that the pump cylinder in the position of cylinder 6 in FIG. 5 could already start with the pressure stroke while the pump cylinder in the position of cylinder 7 in FIG. 5 has not yet wholly completed its pressure stroke. In this case the hydraulic switching means 35 can be embodied such that the valve slide connected to the frame co-rotates each time with the rotatable unit through a small angle so that the mutual position of the openings 45 and the pressure and suction recesses remains unchanged roughly in the position as shown in FIG. 6 until the relevant pump cylinder has fully completed the pressure stroke. At that moment the slide valve parts again move into their normal position whereby the pump cylinder ready for the pressure stroke is activated. A carrier construction which causes this path of movement can be embodied in many different ways such as, for example, with a curve-disc, a crank-drive rod mechanism or the like. In the embodiment of the hydraulic switching means 35 as shown here the positioning slide 38 can perform the reciprocating rotation in a simple manner.

Instead of being used for a periodic rotation through a small angle, the rotatable embodiment of the positioning slide 38 can be used for a rotation through 180 degrees. Mounted for this purpose on the positioning slide 38 is a level 49 which can be operated manually or for example by an air cylinder. On rotation through 180 degrees the pressure recess 42 and the suction recess 44 change places so that the cylinders which carry out a pressure stroke switch to a suction stroke and vice versa. This means that concrete can be sucked out of the pressure conduit 4 and pressed into the feed funnel 3. This option is significant in eliminating blockages occurring in the pressure conduit 4 during operation. By turning the lever 49 back and forth pressure and suction occur alternately whereby a blockage can be rapidly eliminated.

Although the concrete-pumping device described here comprises four pump cylinders it is also possible to achieve pulse-free transportation of concrete through the pressure conduit 4 with three pump cylinders. To this end, it is only necessary according to the invention that each time before a pump cylinder has completed a pressure stroke another pump cylinder has already completed a suction stroke and the pump opening of this other pump cylinder be connected to the discharge line and that the pressure stroke of this other pump cylinder immediately begins at the moment that the pressure stroke of the one pump cylinder has been completed. As described, however, the application of four pump cylinders has the advantage that they can be connected as oppositely moving pairs whereby control of the movements can be embodied very simply.

As can be seen in FIG. 3, a stirring member 50 fixedly connected to the rotatable unit protrudes into the feed funnel 3. This ensures that the concrete in the feed funnel 3 remains well-mixed.

I claim:

1. Concrete-pumping device comprising a frame a number of hydraulic jacks having plungers a number of pump cylinders mounted on the frame which comprise a pump opening close to one end of the frame sealed pump pistons which are guided in the pump cylinders toward and away from the pumping device and which are each coupled for reciprocal driving to the plunger of a coaxially arranged hydraulic jack, hydraulic switching means for cyclically feeding to and discharging from the jack hydraulic oil under pressure such that the plunger causes the reciprocating movement of the pump piston, and concrete switching means for alternately placing the pump opening in communication with a feed funnel and a concrete pressure conduit synchronously with the movement of the pump piston in order to pump concrete out of the feed funnel into the pressure conduit, characterized in that the hydraulic switching means comprise at least three pump cylinders with associated hydraulic jacks and that the hydraulic and concrete switching means are embodied such that each time before a pump piston of a first pump cylinder has completed a pressure stroke another pump piston of another pump cylinder has already completed the suction stroke and the pump opening of this other pump cylinder is connected to the discharge line and that the pressure stroke of this other pump piston begins directly at the moment that the pressure stroke of the one cylinder has been completed with the velocity of the pressure stroke of each pump cylinder being equal to the velocity of the suction stroke of that pump cylinder.

2. Device as claimed in claim 1, characterized in that the pump cylinders with associated hydraulic jacks are assembled into a unit mounted for rotation around a lengthwise shaft wherein all pump cylinders with hydraulic jacks are mounted at the same distance from the lengthwise shaft and substantially parallel thereto, that the concrete switching means comprise a disc fixedly connected to the frame and provided with ports communicating respectively with the feed funnel and the pressure conduit and co-acting therewith a disc fixedly connected to the rotatable unit and provided with ports communicating with the pump openings, and that the device comprises rotation-drive means for causing rotation of the unit relative to the frame.

3. Device as claimed in claim 2, characterized in that the hydraulic switching means comprise a valve connected to the frame and provided with ports connected respectively to hydraulic oil under pressure and a discharge line and co-acting therewith a valve part fixedly connected to the rotating unit and provided with ports connected to the hydraulic jacks.

4. Device as claimed in claim 3, characterized in that the rotation drive means comprise a hydrostatic motor which is connected in the feed line for hydraulic oil to the hydraulic jacks and wherein the rotation drives means are dimensioned such that when a quantity of hydraulic oil has passed through the motor corresponding with a complete reciprocating stroke of all jacks the unit has rotated one revolution.

5. Device as claimed in claim 4, characterized in that the valve of the hydraulic switching means connected to the frame is connected to the frame for rotation through 180 degrees.

6. Device as claimed in claim 5, characterized in that carrier means are arranged which cause the valve connected to the frame to co-rotate reciprocally through a small angle with the rotatable unit, in each case from a normal operating position, in order to delay the moment at which each jack is switched to the pressure stroke and to accelerate setting into operation.

7. Device is claimed in claim 2, characterized in that four pump cylinders with associated hydraulic jacks are arranged with 90 degrees of intervening space and that in each case two pump cylinders with hydraulic jacks situated diametrically opposite one another are connected to oppositely moving parts of plungers.

8. Device as claimed in claim 2, characterized in that the rotatable disc of the concrete switching means is a rotating disc arranged transversely of the lengthwise shaft wherein the open ends of the pump cylinders debouch as pump openings and that the disc fixedly connected to the frame is a fixed disc mounted in contact with the rotating disc and is provided with two oppositely located kidney-shaped openings.

9. Device as claimed in claim 8, characterized in that the device is mounted on a vehicle and that a lower kidney-shaped opening of the fixed disc is connected to the feed funnel and an upper opening to the pressure conduit.

10. Device as claimed in claim 2, characterized in that a stirring member fixedly connected to the rotatable unit protrudes into the feed funnel.

11. Concrete-pumping device comprising a frame, a number of pump cylinders mounted on the frame which comprise a pump opening close to one end of the frame, sealed pump pistons which are guided in the pump cylinders toward and away from the pumping device and which are each coupled for reciprocal driving to the plunger of a coaxially arranged hydraulic jack, hydraulic switching means for cyclically feeding to and discharging from the jack hydraulic oil under pressure such that the plunger causes the reciprocating movement of the pump piston, and concrete switching means for alternately placing the pump opening in communication with a feed funnel and a concrete pressure conduit synchronously with the movement of the pump piston in order to pump concrete out of the feed funnel into the pressure conduit, characterized in that hydraulic switching means comprise at least three pump cylinders with associated hydraulic jacks and that the hydraulic and concrete switching means are embodied such that each time before a pump piston of a first pump cylinder has completed a pressure stroke another pump piston of another pump cylinder has already completed the suction stroke and the pump opening of this other pump cylinder is connected to the discharge line and that the pressure stroke of this other pump cylinder begins directly at the moment that the pressure stroke of the one piston has been completed, the pump cylinders with associated hydraulic jacks being assembled into a unit mounted for rotation around a lengthwise shaft wherein all pump cylinders with hydraulic jacks are mounted at the same distance from the lengthwise shaft and substantially parallel thereto, that the concrete switching means comprise a disc fixedly connected to the frame and provided with ports communicating respectively with the feed funnel and the pressure conduit and co-acting therewith a disc fixedly connected to the rotatable unit and provided with ports communicating with the pump openings, and that the device comprises rotation-drive means for causing rotation of the unit relative to the frame.

12. Device as claimed in claim 11, characterized in that the hydraulic switching means comprise a valve connected to the frame and provided with ports connected respectively to hydraulic oil under pressure and a discharge line and co-acting therewith a valve part fixedly connected to the rotating unit and provided with ports connected to the hydraulic jacks.

13. Device as claimed in claim 12, characterized in that the rotation drive means comprise a hydrostatic motor which is connected in the feed line for hydraulic oil to the hydraulic jacks and wherein the rotation drive means are dimensioned such that when a quantity of hydraulic oil as passed through the motor corresponding with a complete reciprocating stroke of all jacks the unit has rotated on revolution.

14. Device as claimed in claim 13, characterized in that the valve of the hydraulic switching means connected to the frame is connected to the frame for rotation through 180 degrees.

15. Device as claimed in claim 14, characterized in that carrier means are arranged which cause the valve connected to the frame to co-rotate reciprocally through a small angle with the rotatable unit, in each case from a normal operating position, in order to delay the moment at which each jack is switched to the pressure stroke and to accelerate setting into operation.

16. Device as claimed in claim 11, characterized in that four pump cylinders with associated hydraulic jacks are arranged with 90 degrees of intervening space and that in each case two pump cylinders with hydraulic jacks situated diametrically opposite one another are connected to oppositely moving pairs of plungers.

17. Device as claimed in claim 11, characterized in that the rotatable disc of the concrete switching means is a rotating disc arranged transversely of the lengthwise shaft wherein the open ends of the pump cylinders debouch as pump openings and that the disc fixedly connected to the frame is a fixed disc mounted in contact with the rotating disc and is provided with two oppositely located kidney-shaped openings.

18. Device as claimed in claim 17, characterized in that the device is mounted on a vehicle and that a lower kidney-shaped opening of the fixed disc is connected to the feed funnel and an upper opening to the pressure conduit.

19. Device is claimed in claim 11, characterized in that a stirring member fixedly connected to the rotatable unit protrudes into the feed funnel.

* * * * *